US005755375A

United States Patent [19]

Rogers

[11] Patent Number: 5,755,375

[45] Date of Patent: May 26, 1998

[54] CARBONLESS SELF-MAILER

[75] Inventor: Arthur M. Rogers, New York, N.Y.

[73] Assignee: Exclusive Envelope Company, New York City

[21] Appl. No.: 538,128

[22] Filed: Oct. 2, 1995

[51] Int. Cl.[6] ..... B65D 27/00

[52] U.S. Cl. ..... 229/70; 462/64; 462/65

[58] Field of Search ..... 462/64, 65; 229/70

[56] References Cited

U.S. PATENT DOCUMENTS

| | | | |
|---|---|---|---|
| 755,159 | 3/1904 | Morton | 462/65 |
| 791,362 | 5/1905 | Parmenter | 462/64 |
| 846,064 | 3/1907 | Souder | 462/65 |
| 893,202 | 7/1908 | Shaw | 229/70 |
| 1,211,819 | 1/1917 | Brown | 462/64 |
| 1,401,324 | 12/1921 | Dority et al. | 462/65 |
| 1,567,875 | 12/1925 | Swanson | 462/65 |
| 1,588,875 | 6/1926 | Curtis | 229/70 |
| 1,655,912 | 1/1928 | McNair et al. | 229/70 |
| 2,835,512 | 5/1958 | Whitman | 462/64 |
| 2,983,525 | 5/1961 | Mercur | 462/65 |
| 2,987,327 | 6/1961 | Carmichael | 229/70 |
| 3,111,336 | 11/1963 | Schumacher | 462/64 |
| 4,448,445 | 5/1984 | Chang et al. | 229/70 |
| 4,690,433 | 9/1987 | Showers et al. | 462/65 |
| 5,338,068 | 8/1994 | Arbach et al. | 462/65 |
| 5,375,763 | 12/1994 | Sauerwine | 229/303 |

FOREIGN PATENT DOCUMENTS

| | | | |
|---|---|---|---|
| 227015 | 1/1925 | United Kingdom | 462/65 |

*Primary Examiner*—Stephen P Garbe

*Attorney, Agent, or Firm*—Lackenbach Siegel Marzullo Aronson & Greenspan P.C.

[57] ABSTRACT

A blank for making an envelope from paper sheet stock and an envelope made from paper entirely or partially coated with a microencapsulated material that produces a visible record copy marking upon application of a force thereto and creation of an original marking thereby. The blank and the envelope have a first panel having a sealing flap and a pair of end flaps. A second panel is connected to the first panel, a third panel connected to the second panel, and a fourth panel connected to said third panel. At least the third and fourth panels are made from a front coated carbonless paper. Optionally, the fourth panel includes a back coated carbonless paper. Assembly of the blank to create the envelope and use of an instrument on the assembled envelope permits a user to create an original marking on a panel and simultaneously create a visible copy of the marking on another panel of the envelope by applying a force with the instrument. The copy is generally, but not always, substantially identical record copy of the original marking.

28 Claims, 10 Drawing Sheets

CARBONLESS SELF-MAILER

This invention relates to a carbonless self-mailer; and, more particularly, it relates to an improved carbonless bang tail envelope for use in the payment of bills, and the forwarding of advertising and other information to a recipient, and the creation of an original marking and a simultaneously created record copy thereof. Alternately, the invention also relates to a self-mailer of carbonless paper that can be used as a magazine insert for promotions and subscriptions and/or payment of invoices or subscriptions. It may even be utilized for ordering merchandise.

BACKGROUND OF THE INVENTION

Recently, there has been a growing trend in the use of magazine inserts, bang tail envelopes by entities such as telephone companies, magazines publishers, oil companies, financial companies, department stores, retail stores for the promotion of cosmetics and consumer related promotions. Bang tail envelopes are used to generally transmit information to a recipient. However, there has been no easy way for a user to transmit information to a recipient and to create a substantially identical simultaneously created record copy with the use of a pen or other instrument. Hence, there exists a need for bang tail envelope that permits the creation of a substantially identical, simultaneous record copy of original markings made on a portion of a bang tail envelope, and is of low cost to manufacture and produce.

SUMMARY OF THE INVENTION

It is an object of the present invention to provide an improved envelope blank, envelope, and magazine insert having multiple panel portions. At least one of the panel portions is capable of being written on. The improved envelope blank, envelope, and magazine insert have at least one other panel portion disposed in a juxtaposed position so as to make a simultaneous duplication of a marking on the first panel to be impressed on the second panel. The first and second panels are formed of carbonless paper stock.

It is an object of the present invention to provide a lost cost, bang tail envelope that permits the creation of a substantially identical, simultaneous record copy of original markings made on a portion of a bang tail envelope. The present invention provides a blank for making an envelope from paper sheet stock and an envelope made from coated, microencapsulated paper. The blank and the envelope have a first panel having a sealing flap and a pair of end flaps. A second panel is connected to the first panel, a third panel is connected to the second panel, and a fourth panel connected to the third panel. At least the third and fourth panels are made from a front coated carbonless paper in one variant. Optionally, the fourth panel includes a back coated carbonless paper. Assembly of the blank to create the envelope and use of an instrument on the assembled envelope permits a user to create an original marking on a panel and simultaneously create a visible copy of the marking on another panel of the envelope by applying a force with the instrument. The copy is a substantially identical record copy of the original marking.

Optionally, the first and second panels, flaps and the first panel, the second and third panels, and the third and fourth panels have side edges between respective panels and flaps. The side edges are selected from the group consisting of a fold line and a perforated line. Further, the panels form an in-line chain panel with at least one side edge of each of the panels being connected to a side edge of an adjacent in-line chain panel.

In yet another variant, the fourth panel includes a composite panel. The composite panel has microencapsulated coatings thereon for creating a visible marking on at least one of the panels, and is attached with an adhesive to the fourth panel. Preferably, the composite panel is applied to the fourth panel with a back coated side facing the third panel, and all of the flaps have fold lines disposed between the flaps and the first panel. The first panel and the second panel have a fold line at the side edge therebetween. The second and third panel, and the third and fourth panel have a severable perforation at the side edge therebetween so that respective panels are readily detached one from another along the severable perforation.

The objects and features of the present invention, other than those specifically set forth above, will become apparent in the detailed description of the invention set forth below.

DETAILED DESCRIPTION OF THE INVENTION

Figure 2:
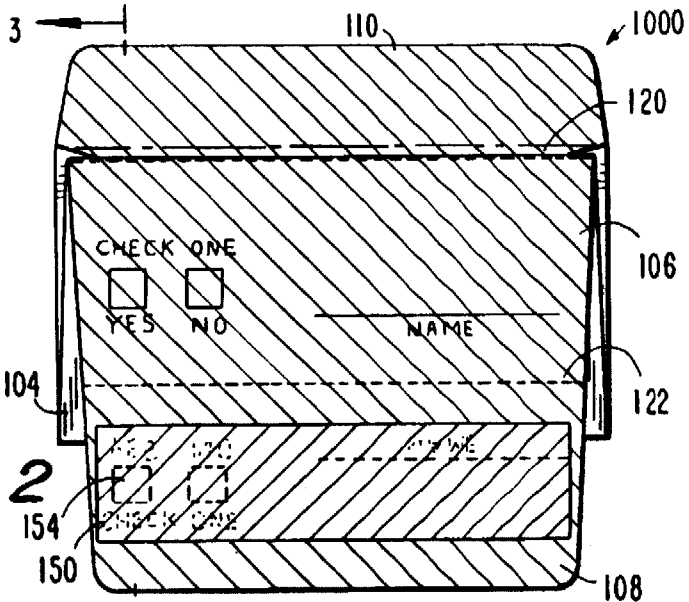
FIG. 2 is a top plan view of a partially assembled envelope using the blank of FIG. 1.
Figure 4:
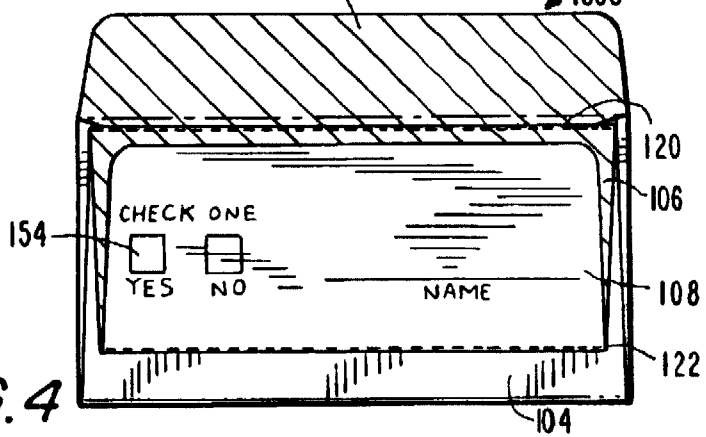
FIG. 4 is a top plan view of a fully assembled envelope of FIG. 3.
Figure 1:
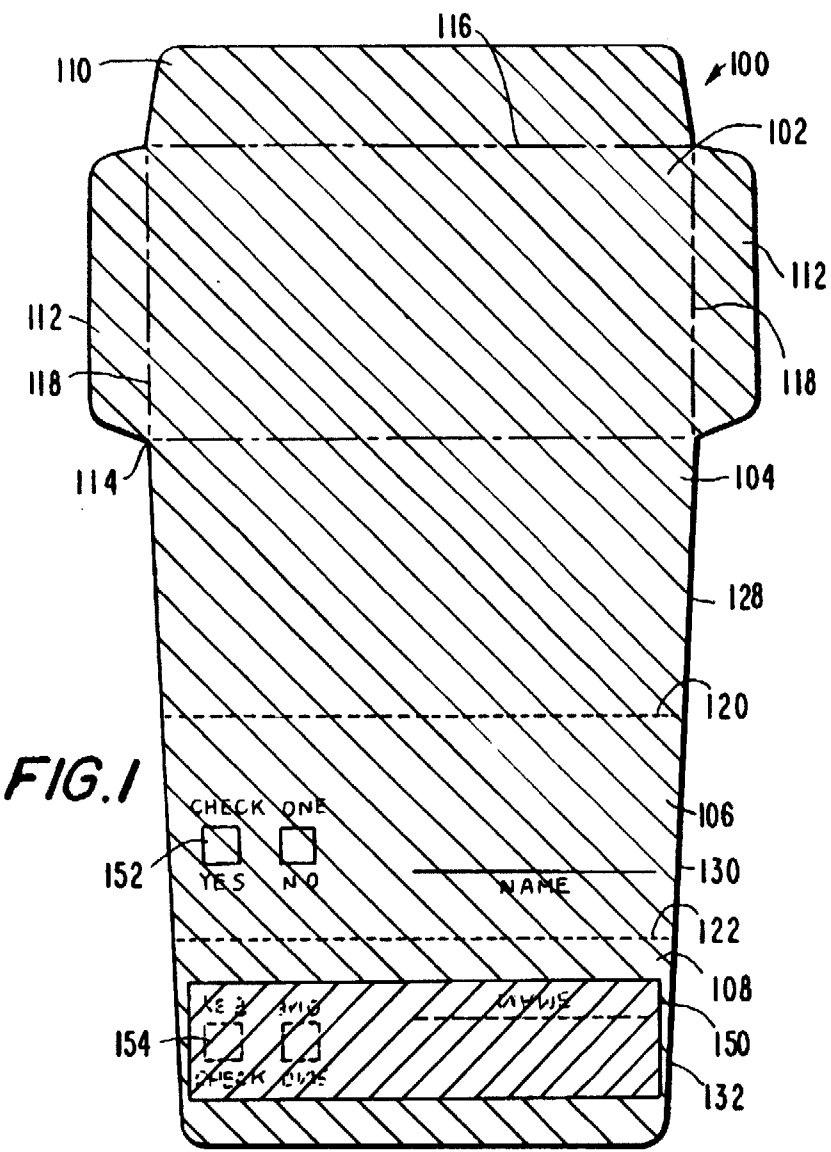
FIG. 1 is a top plan view of the blank for making an envelope from paper sheet stock.
Figure 8:
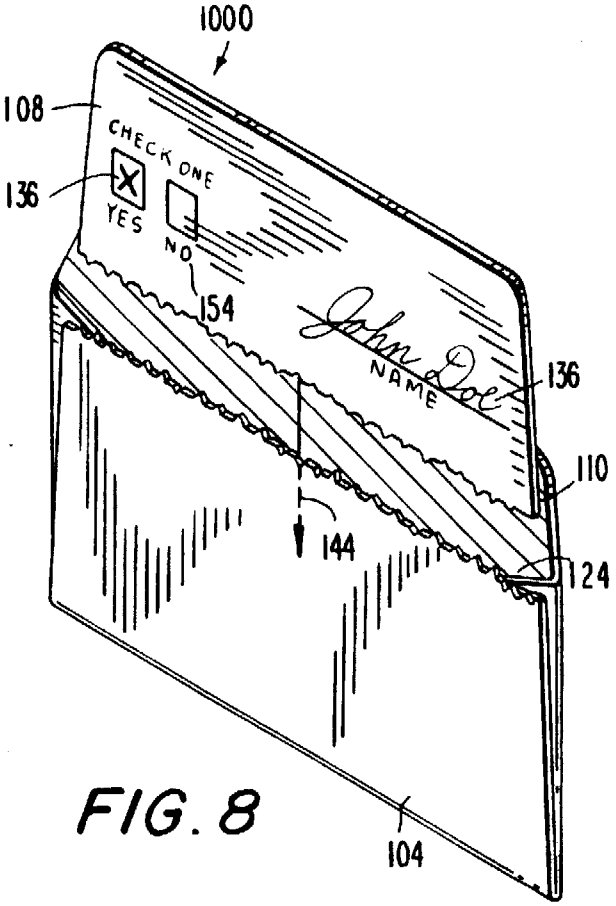
FIG. 8 is a perspective view of the envelope of FIG. 5 illustrating the insertion of panel 4 of FIG. 5 into a cavity of the envelope.
Figure 5:
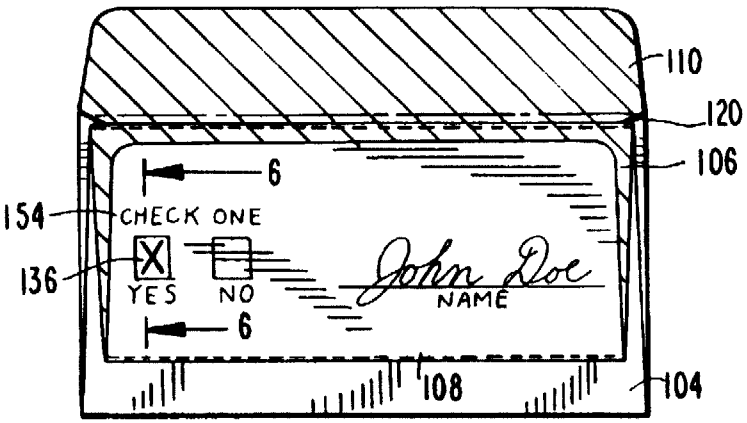
FIG. 5 is a top plan view of the fully assembled envelope of FIG. 4 having an original marking on a portion thereof.
Figure 7:
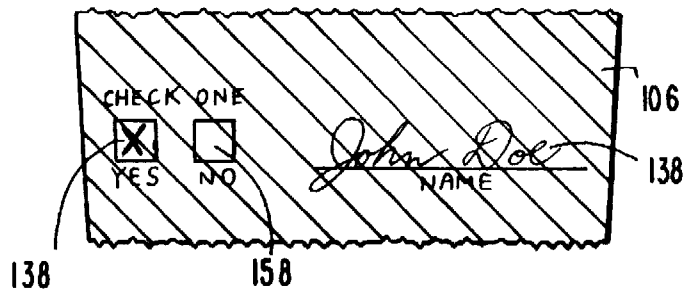
FIG. 7 is a side view of panel three of the envelope of FIG. 4.
Figure 9:
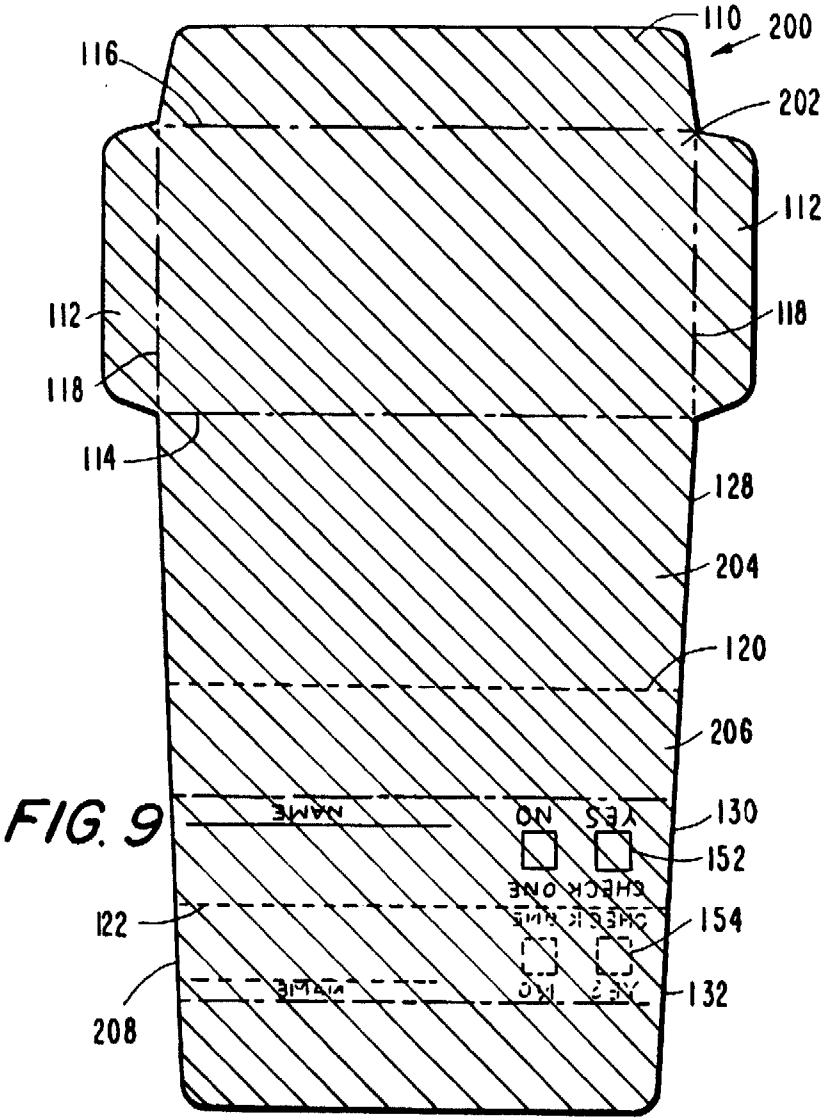
FIG. 9 is a top plan view of a variant of the blank of FIG. 1 having a multiple folded panel assembly.
Figure 17:
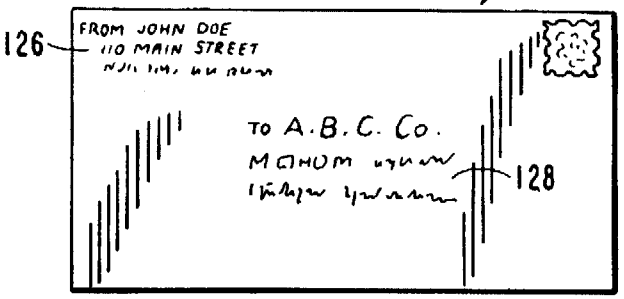
FIG. 17 is a top plan view of a first panel of the envelopes described herein having markings thereon.
Figure 18:
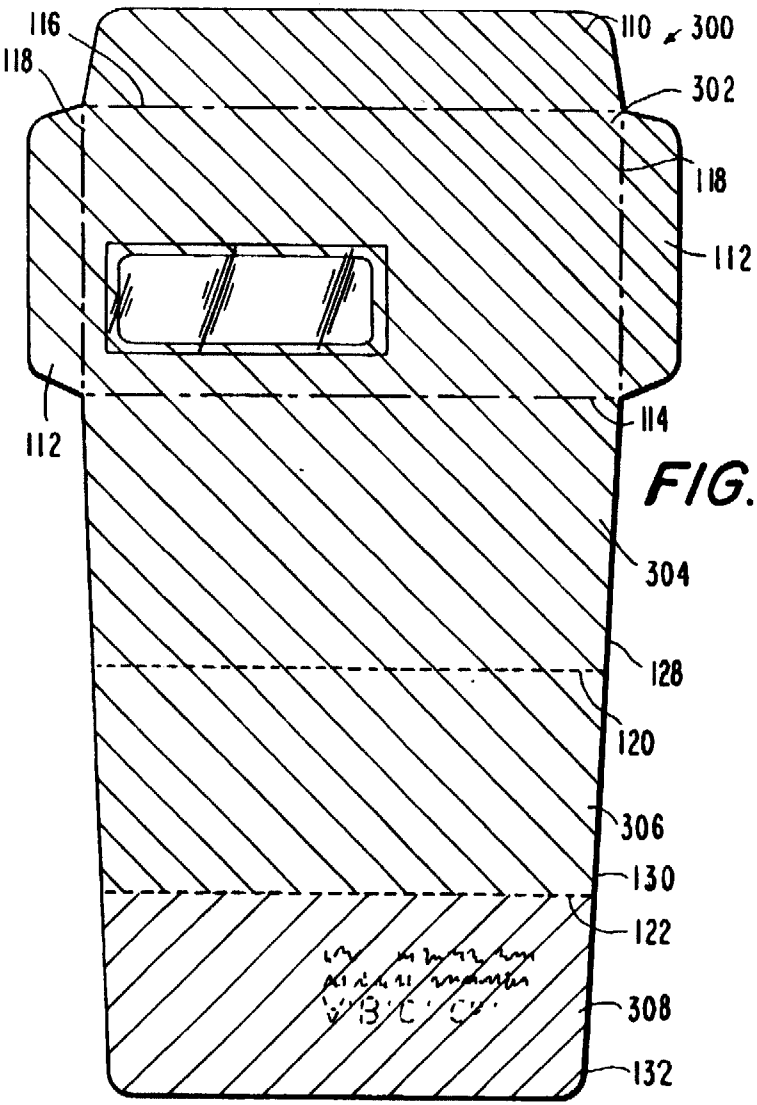
FIG. 18 is a top plan view of a variant of a blank of FIGS. 1 and 9 formed from front and back coated carbonless paper.

FIGS. 1, 9 and 18 illustrate top plan views of blank 100 (FIG. 1), blank 200 (FIG. 9), and blank 300 (FIG. 18), respectively. Blanks 100, 200 and 300 are generally constructed of paper sheet stock that include carbonless paper. Blank 400 (FIG. 20) is constructed of standard sheet stock with only a portion thereof comprising a front coated carbonless paper coating and another mating portion constructed of a back coated carbonless paper. By way of example the carbonless papers described herein are based upon the well known NCR (National Cash Register of Dayton, Ohio) patents for carbonless paper. Envelopes 1000 (FIGS. 2, 4, 5, and 8), 2000 (FIGS. 10, 12, 13, and 16), 3000 (FIG. 17), and 4000 (FIG. 19) are constructed of and assembled from blanks 100, 200, 300, 400 and variants thereof.

Blank 100 includes first panel 102 (FIGS. 1, 3, and 6), second panel 104 (FIGS. 1, 2, 3, 4, 5, 6 and 8), third panel 106 (FIGS. 1, 2, 3, 4, 5, 6 and 7), and fourth panel 108 (FIGS. 1, 2, 3, 4, 5 and 8). Panels 102, 104 are analogous to panels 202 (FIGS. 9, 11, and 14) and 204 (FIGS. 9, 10, 11, 12, 13, 14 and 16), and panels 302 and 304 (FIG. 18), respectively. First panels 102, 202, 302 have a sealing flap 110 (FIGS. 1–5, 8–13 and 16–18) and a pair of end flaps 112 (FIGS. 1, 9 and 18). Flaps 110, 112 are connected to first panels, 102, 202, 302 at side edges 116, 118, respectively (FIGS. 1, 9, 18). Flaps 112 are optional and panels, 102, 104 can be connected by other means to form envelope cavity 124. For example, panels 102, 104 are connected at side edges 118 by adhesive, and the like. In yet another variant panels 102, 104 are formed from a single piece of paper stock such that only one edge 118 of panels 102, 104 is joined by adhesive and the other edge 118 is a fold line. Panels 102, 104, 106 and 108, and 202, 204, 206, and 208 are constructed of a front coated carbonless paper as described herein.

It is understood that as described herein a front coated carbonless paper must "kiss" or mate with a back coated carbonless paper to produce the desired record copies of original markings described herein. Hence, it is appreciated that where a panel is described as being constructed of a front coated carbonless paper a mating panel must be constructed of a back coated carbonless paper. Similarly, it is appreciated that where a panel is described as being constructed of a back coated carbonless paper a mating panel must be constructed of a front coated carbonless paper. Hence, a front coated carbonless paper may be substituted with a back coated carbonless paper as long as there is a mating of one type of carbonless paper with the other type of carbonless paper.

Second panels 104, 204, 304 are connected to first panels 102, 202, 302 (FIGS. 1, 9 and 18), respectively. Second panels 104, 204, 304 are connected to first panels 102, 202, 302 at side edge 114 located therebetween, respectively (FIGS. 1, 3, 9, and 18). Second panels 104, 204, 304 are connected to third panels 106, 206, 306 at side edge 120 located therebetween, respectively (FIGS. 1, 2, 3, 4, 6, 9, and 18). Third panels 106, 206, 306, are connected to fourth panels 108, 208, 308, respectively, at side edge 122 located therebetween (FIGS. 1, 2, 4, 6, 9, 10, 14, and 18). Side edges 120, 122, optionally, begin and terminate with a notch (not shown) to assist in the separation of the various panels one from another.

Figure 19:
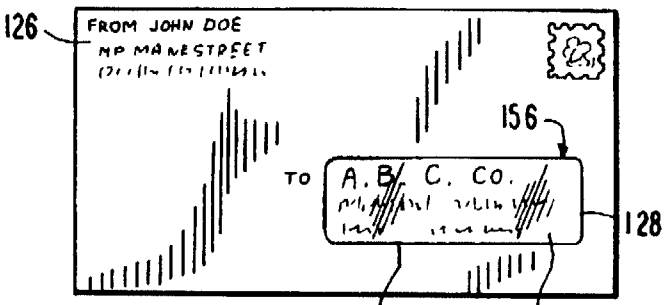
FIG. 19 is a top plan view of a first panel of the envelopes described herein having an optional window thereon.

Side edges 114, 116, 118, 120, 122 are selected from the group consisting of a fold, a score, and a perforation. As illustrated in FIGS. 1, 9 and 18, edges 120, and 122 are preferably scored lines allowing for ease of separation or detachment of panels 106, 206, and 306, from panels 108, 208, and 308. Upon separation of panels 106, and 108 respectively, panel 106 is kept as a record copy (FIG. 7), and panel 108 as illustrated in FIG. 8 is inserted in envelope cavity 124, and flap 110 is thereafter sealed and envelope 1000, 2000, 3000 (FIG. 17) and 4000 (FIG. 18) are respectively addressed with return address 126 and receiving address 128 (FIGS. 17 and 18). Alternately, panel 106 is inserted into envelope cavity 124 and panel 108 is inserted as a record copy. Panels 106, 108 include option address indicia 126, or variant thereof, visible through window 156 on a side thereof (FIG. 19).

Panels 102, 104, 106, and 108 (FIG. 1); panels 202, 204, 206, and 208 (FIG. 9); panels 302, 304, 306, and 308 (FIG. 18); and, panels 402, 404, 406, 409 (FIG. 20), respectively, form an in-line chain panel with at least one side edge, 114, 120, and 122 of each of the panels being connected to a side edge of an adjacent in-line chain panel.

Figure 20:
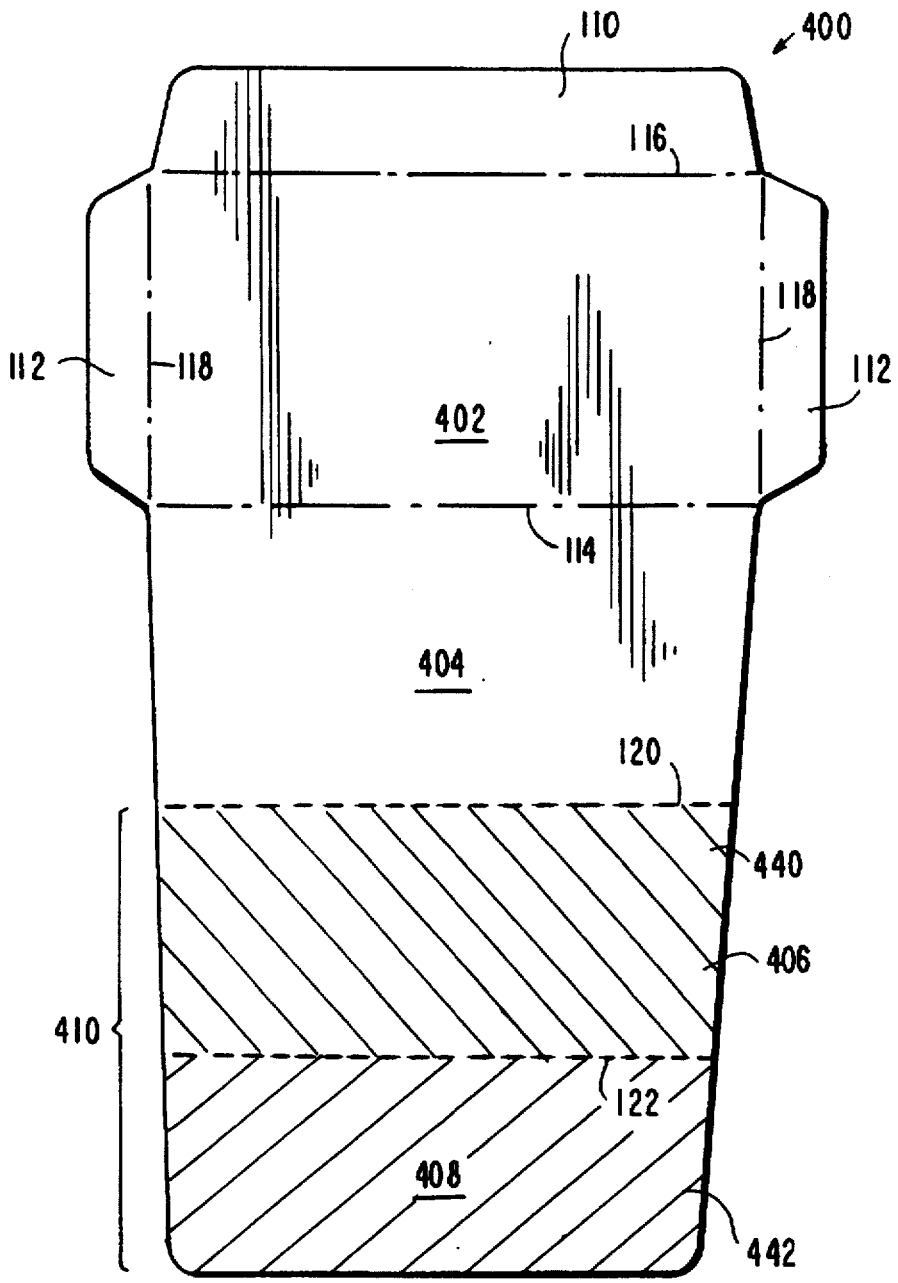
FIG. 20 is a top plan view of a variant of an envelope blank made from standard paper stock with only a portion thereof having a front coated microencapsulated coating and a back coated microencapsulated coating thereon.

Panels 102, 104, 106, and 108 (FIG. 1); panels 202, 204, 206, and 208 (FIG. 9); and, panels 302, 304, and 306 (FIG. 18), and panel 406 (FIG. 20) respectively, are constructed from of fabricated from a front coated carbonless paper. Exemplary, front coated carbonless papers include papers available commercially from Appleton Papers, Inc. under the trade name NCR Paper® brand of carbonless paper, e.g. CF White 20#. Optionally, as illustrated in FIGS. 18 and 20, panels 308, 408, respectively, are constructed of fabricated from a back coated carbonless paper, e.g. papers available commercially from Appleton Papers, Inc. under the trade name NCR Paper® brand of carbonless paper, e.g. CB White 16# Black Print. It is understood that carbonless papers from other commercially available sources are also used herein, and/or the papers contain microencapsulated inks of all different colors under the spectrum. These commercially available sources include 3M Company of Minnesota, and the like, and also other carbonless papers having microencapsulated coatings thereon that produce a visible marking upon activation of said paper with an instrument.

It is also preferable to make the length of side edges 114, 116, 120, and 122, respectively, greater than the length of side edges 118, 128, 130, 132 (FIGS. 1, 9 and 18). This choice of dimensions allows for insertion of documents of standard dimensions, e.g. 8.5 inch by 11 inch folded documents, and the like, to be inserted into envelopes 100, 200, and 300 readily. Generally, the length of side edges 114, 116, 120, and 122, respectively, is at least two times greater than the length of side edges 118, 128, 130, 132, respectively.

Figure 6:
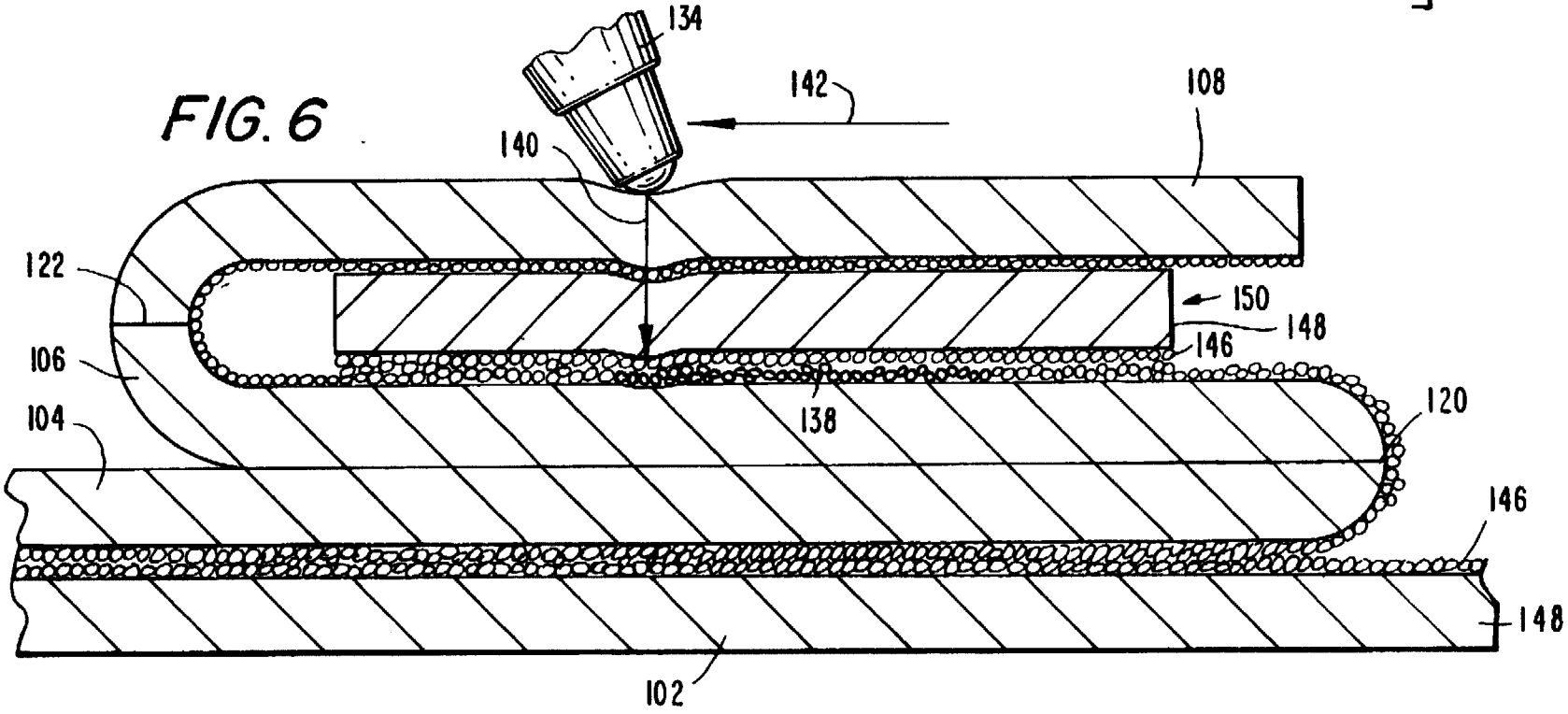
FIG. 6 is a side cross-sectional view of the assembled and marked envelope of FIG. 5 along sectional line -6, and a marking instrument.
Figure 14:
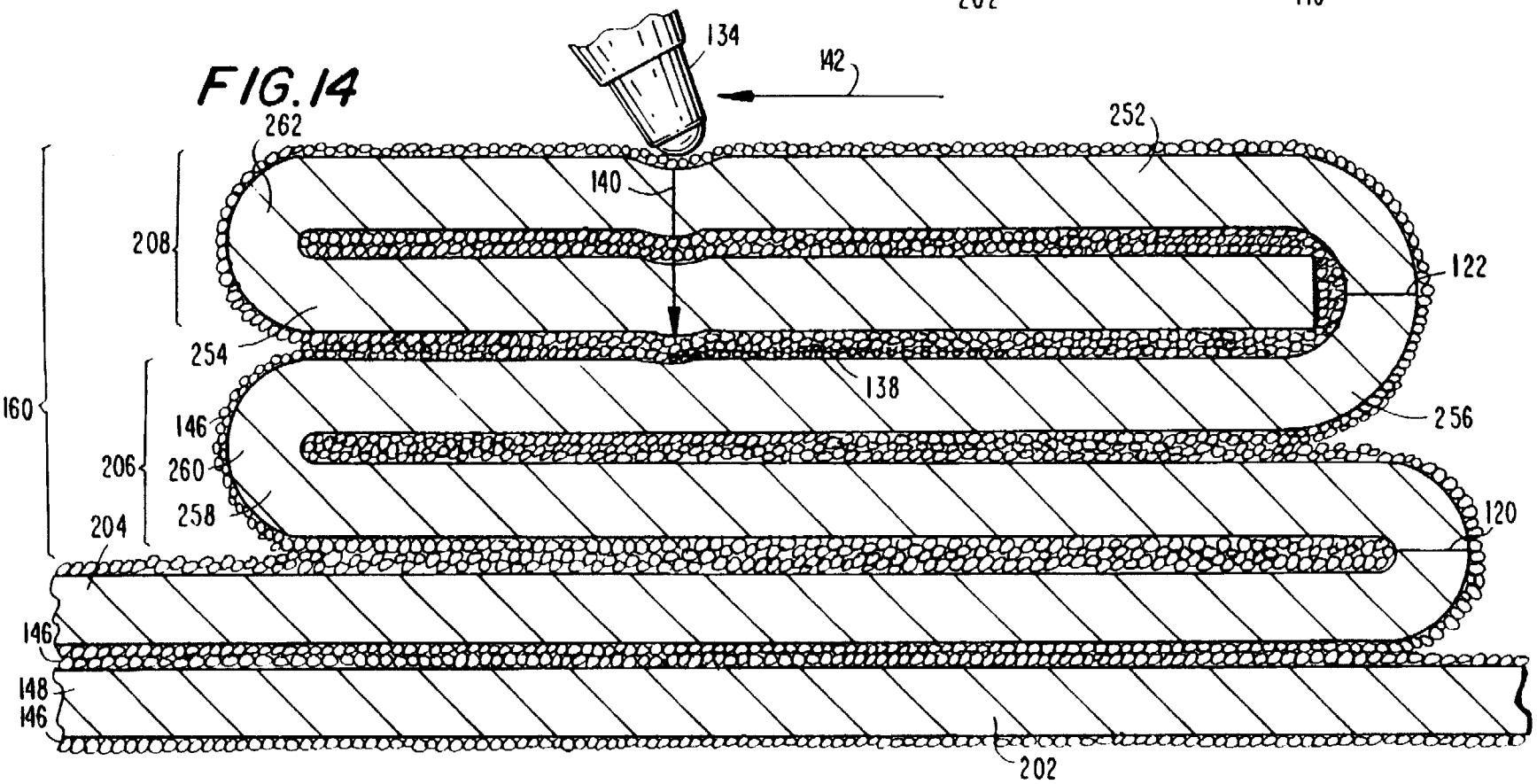
FIG. 14 is a side cross-sectional view of the assembled and marked envelope of FIG. 13 along sectional line -6, and a marking instrument.
Figure 16:
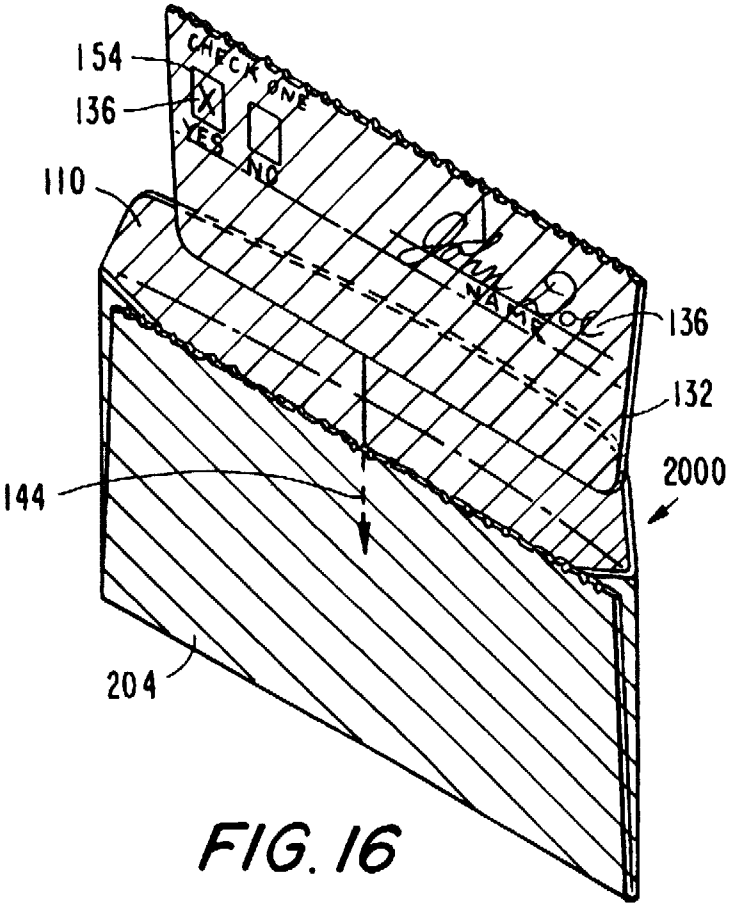
FIG. 16 is a perspective view of the envelope of FIG. 13 illustrating the insertion of panel four of FIG. 10 into a cavity of the envelope.
Figure 13:
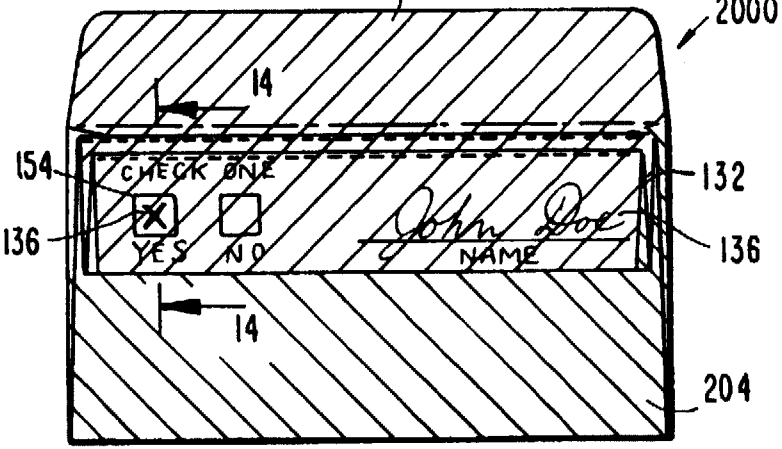
FIG. 13 is top plan view of the envelope of FIG. 10 with original markings on a portion thereof.
Figure 15:
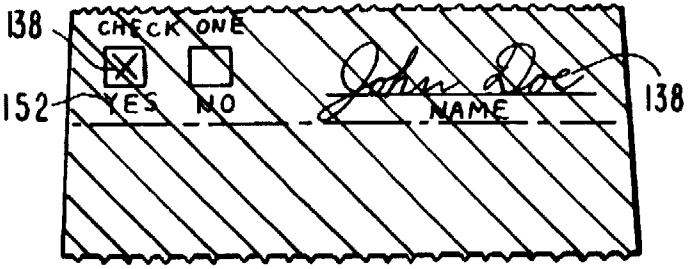
FIG. 15 is a top plan view of panel three of the envelope of FIG. 13.

The assembly of blanks 100, 200, 300 and 400 into envelopes 1000, 2000, 3000, and 4000, and use of instrument 134 (FIGS. 6 and 14) permits a user (not shown) to create visible, original record markings 136 (FIGS. 5, 6, 8, 13, and 16) on panel 106 (FIGS. 5, 6, 8, 13 and 16) by applying a downward force (FIG. 6) as indicated by the phantom line 140 in FIGS. 6 and 14 through the movement of instrument 134 as indicated by phantom line 142 (FIGS. 6 and 14). At the same time as instrument 134 exerts the force in a downward direction against the panels and moves in a horizontal direction as indicated by phantom line 142, original marking 136 and copy marking 138 (FIGS. 6, 7, 14, and 15) are simultaneously created. Copy marking 138 is a substantially identical record copy of original marking 136.

FIGS. 6 and 14 illustrate the use of instrument 134, and show instrument 134 activating microencapsulated coating 146 so that visible record marking 138 is created on a respective panel(s). Microencapsulated coating 146 is disposed on one side of paper stock 148 as illustrated in FIG. 6 (a front coated paper). In a variant, different types of microencapsulated coating 146 is disposed on both sides of paper stock 148 as illustrated in FIG. 14. Coatings 146 in this figure include a front coated carbonless paper coating on one side of stock 148 and a back coated carbonless paper coating on the other side of stock 148.

It is appreciated that panels 108, 208, and 308 comprising original markings 136 are detached from the other panels and inserted in envelope cavity 124 as indicated by phantom line 144 (FIGS. 8 and 16) while panels 106, 206, 306 (FIGS. 7 and 15) are retained by a user for his or her own records. It is further appreciated that the amount of time spent to create an original and record copy of a document is greatly reduced, and the ease and convenience of filling out a telephone service order form, retail store order form, and the like is greatly increased.

Figure 3:
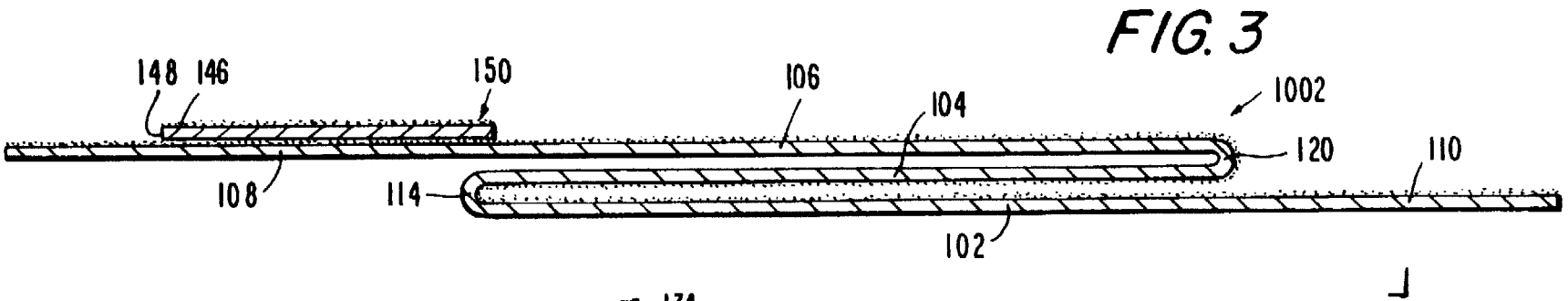
FIG. 3 is a side cross sectional view of the envelope of FIG. 2 along sectional line -3.

As illustrated in FIGS. 1, 2, 3 and 6, blank 100, and envelope 1000 have optional patch panel 150. Patch panel 150 comprises a microencapsulated coating 146 on paper stock 148 (FIGS. 3 and 6) for creating visible marking 138 on at least one other panel(s). As illustrated in FIGS. 3 and 6, patch panel 150 is created from a back coated carbonless paper (NCR® CB Black Ink carbonless paper), and panels 102, 104, 106 and 108 are created from a front coated carbonless paper as described herein. In yet a further variant, panels 302, 304, 306, and 406 are created from a front coated carbonless paper and panels 308, 408 are created from a back coated carbonless paper (FIGS. 18 and 20). Patch panel 150 is attached to panel 108 with an adhesive, or by any other suitable means. In the variant in FIG. 18, panel 308 can be attached to panel 306 by any suitable means, such as adhesive or tape, or alternatively can be created from a single piece of paper stock such that panels 302–306 are of front coated carbonless paper and panel 308 is of back coated carbonless paper. It is understood that the combinations of the various carbonless papers on the various panels are numerous, and the carbonless papers can be combined in a myriad of different combinations without departing from the spirit and scope of the invention, and still result in the simultaneous creation of copy record marking 138 on a panel and original record marking 136 on another panel.

Preferably, patch panel 150 is applied to fourth panel 108 with back coated side 146 facing third panel 106, and patch panel 150 is no larger than fourth panel 108. When patch panel 150 is applied to a panel the resultant panel is referred to herein as a composite panel. All of flaps 110, 112 have fold lines 116, 118 are disposed between flaps 110, 112, and first panel 102. First panel 102 and second panel 104 have a side edge 114 that is a fold line therebetween. Second panel 104 and third panel 106 have side edge 120 that is a severable perforation therebetween. Third panel 106 and fourth panel 108 also have a side edge 122 that is a severable perforation therebetween. Consequently, second panel 104 and third panel 106 are readily detached one from another along the severable perforation. Similarly, third panel 106 and fourth panel 108 are readily detached one from another along the severable perforation.

Patch panel 150 preferably is narrow in width so that the opposite side runners of conventional envelope machines do not interfere with patch panel or portion 150. In those embodiments not having patch 150, there is no such interference problem. In theory, if patch 150 and underlying panel together are thin enough in thickness so that there would be no interference with the runners, then the patch portion 150 can be the full width of the underlying panel. Preferably, patch panel 150 is coated with adhesive around the periphery thereof so as to preclude interference with the indicia transfer. Alternatively, patch portion 150 can be "spot welded" to the underlying panel so as to minimize the interference of the indicia transfer to virtually "zero" defect so long as the patch panel 150 is adequately adhered to the underlying panel. In addition, while the flaps are indicated herein to be adhesively secured to a panel, other conventional methods of attachment could be used, e.g. conventional adhesives, self-adhesives (of the type used in labels and stamps).

Figure 22B:
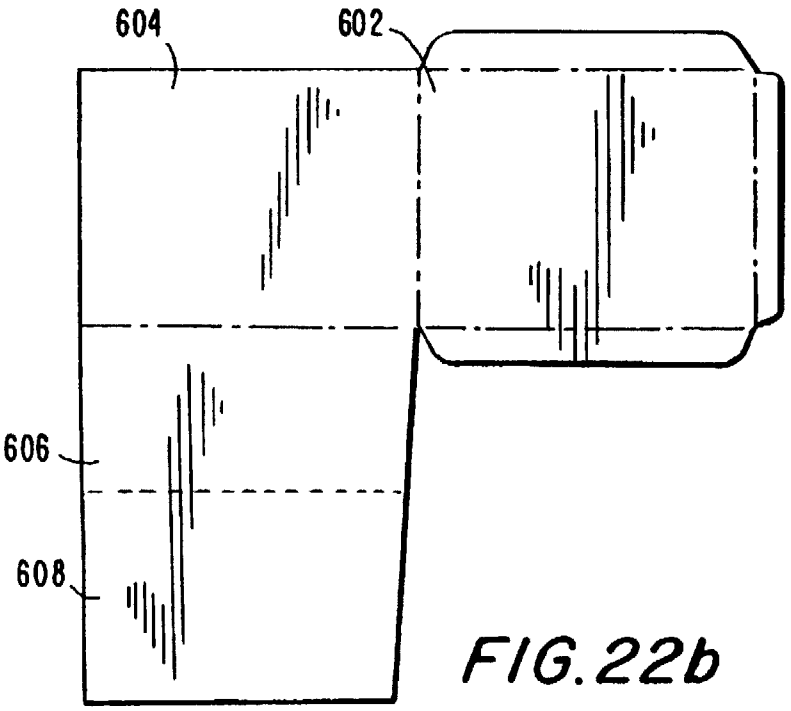
FIG. 22*b* is a top plan view of an "L" shaped envelope blank.
Figure 22C:
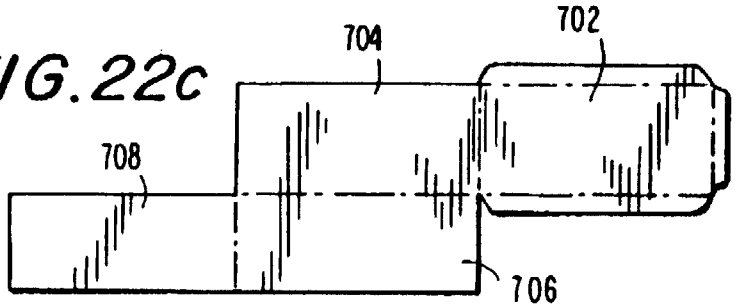
FIG. 22*c* is a top plan view of an "S" shaped envelope blank.

Blanks 100, 200, 300 and 400 are also "L" shaped with the first panel 602 and second panel 604 being horizontally connected in lieu of a vertical in-line connection, and the remaining panels, panels 606, 608 are connected in-line as illustrated in FIG. 22*b*. In yet another variant, blanks 100, 200, 300 and 400 are also "S" or "Z" shaped with the first panel 702 and second panel 704 being horizontally connected in lieu of a vertical in-line connection, and the third panel 706 and fourth panel 708 are also horizontally connected, with only the second panel 704 and third panel 706 being vertically in-line as illustrated in FIG. 22*c*. Of course, it is appreciated that the panels side edges are appropriately disposed so that the scope and spirit of the invention is not departed therefrom, and that a record copy 138 is created simultaneously with the original order copy marking created by instrument 134.

Blanks 100, 200 and 300 are also created from coated back paper. The coated back paper is used as a transfer agent in one variant. Accordingly, using coated front paper and writing thereon with instrument 134 transfers markings made thereon to an interposed coated back paper.

Analogously, as illustrated in FIG. 9, first panel 202 and second panel 204 have a side edge 114 that is a fold line therebetween. Second panel 204 and third panel 206 have side edge 120 that is a severable perforation therebetween. Third panel 206 and fourth panel 208 have a side edge 122 that is a severable perforation therebetween. Consequently, second panel 204 and third panel 206 are readily detached one from another along the severable perforation. Similarly, third panel 206 and fourth panel 208 are readily detached one from another along the severable perforation.

Likewise, as illustrated in FIG. 18, first panel 302 and second panel 304 have a side edge 114 that is a fold line therebetween. Second panel 304 and third panel 306 have side edge 120 that is a severable perforation therebetween. Third panel 306 and fourth panel 308 have a side edge 122 that is a severable perforation therebetween. Consequently, second panel 304 and third panel 306 are readily detached one from another along the severable perforation. Similarly, third panel 306 and fourth panel 308 are readily detached one from another along the severable perforation. Panels 302, 304 and 306 are front coated, and panel 308 is back coated in a variant.

Optionally, permanent indicia 152, 154 are disposed on said third panel 106 and fourth panel 108 (FIGS. 1, 2, 4, 5, 7, and 8), third panel 206 and fourth panel 208 (FIGS. 9, 10, 12, 13, 15, and 16), and third panel 306 and fourth panel 308 (not shown). Indicia 152 is preferably the mirror image of indicia 154 along an axis of symmetry along a side edge. Indicia 152, 154 are used as guides for original markings 136 and record copy markings 138 to allow the user to enter information that will latter be extracted from and/or stored on the various panels.

As illustrated in FIG. 19, envelope 4000 includes an optional first panel with window 156 which comprises aperture 160 and a transparent or translucent film or plastic 158. It is further understood that envelopes 3000, and 4000 (FIGS. 17 and 19) and the blanks therefore include variants in which all of the panels and flaps thereof are of a coated carbonless paper that includes microencapsulated beads 146 for creating a visible marking on at least a single side of the panels. It is further understood that envelopes 1000, 2000, 3000, and 4000 are made from microencapsulated coated paper and have first panels 102, 202, 302, respectively, having sealing flap 110, a pair of end flaps 112, and first side edge 114; second panels 106, 206, and 306, are connected to first panels 102, 202, and 302, respectively, along first side edge 114. Second panels 106, 206, and 306 have a second side edge 120. Second panels 104, 204, and 206 are connected to the pair of end flaps 112 by a suitable means including adhesives and the like, and to first panel 102 along the first side edge 114 to form an envelope cavity 124, 224, respectively. Third panels 106, 206, 306 are connected to the second panels 104, 204, 304 along second side edge 120. Third panels 106, 206, 306 have a third side edge 122. Third side edge 122 is opposite to second side edge 120 of second panel 106, 206, 306. Fourth panels 108, 208, 308 are connected to third panels 106, 206, 306, respectively, along third side edge 122. Generally, first panels 102, 202, 302, second panels 104, 204, 304, and third panels 106, 206, and 306, sealing flap 110, pair of end flaps 112, comprise a front coated carbonless paper. Optionally, fourth panels 108, 208 and 308 comprise a back coated carbonless paper. Third panels 106, 206, and 306 and fourth panels 108, 208, 308 are folded, respectively, such that at least a portion of fourth panels 108, 208, and 308 rests against at least a portion of the respective third panels 106, 206, and 306. Exemplary embodiments illustrating these types of various foldings are shown in FIGS. 6 and 14. The various foldings allow the use of instrument 134 such that a user creates visible copy record marking 136 on at least one the panels by applying a force with instrument 134 as previously discussed against at least the fourth panel in one embodiment from original marking 138.

FIG. 14 illustrates envelope 2000 that includes multiple folded assembly 160. Multiple folded assembly 160 comprises panels 206 and 208. The third and fourth panels optionally comprise a plurality of smaller panels 252, 254, 256, 258 formed from the respective third panel 206, and fourth panel 208. An instrument 134 activates the carbonless paper coating creating copy marking 138 and an original marking 136 on sub-panel 252, it is appreciated that marking 138 will form on sub-panel 256 of panel 206. Generally, with the application of a standard force with instrument 134 further markings will not be created on panels 258 and the other panels disposed below panel 258. Preferably, panels 252, 254, 256, and 258 are of substantially equal size, and side edges 260 and 262 are fold lines.

FIG. 20 illustrates a variant of an envelope blank that is constructed of plain paper stock having a first panel 402 that has sealing flap 110 and a pair of end flaps 112. Second panel 404 is connected to first panel 402, and to the pair of side flaps 112 to form envelope cavity 124 as discussed previously. Third panel 406 is connected to second panel 404, and fourth panel 408 is connected to third panel 406. As discussed previously, panels 402–408 form an in-line chain panel with at least one side edge 114, 120, and 122 of each panels 402–408 being connected to a side edge of an adjacent in-line chain panel. In this variant, a record copy portion 410 comprising a carbonless paper coating 440, analogous to the front coated carbonless paper coatings previously described, is applied to the entire area of panel 406 or portion thereof. Panel 408 has a back coated carbonless paper coating 442 thereon. It is understood that the record copy portion 410 is disposed on one or more of panels 406, 408, or combination thereof so as to simultaneously create a visible record copy 138 of an original marking 138 created on a panel other than the panel having the record copy portion thereon. By way of example, where panel 406, or portion thereof comprises the microencapsulated coatings comprising an ink for creating a visible marking thereon, panel 408, is folded over so that panel 408 rests over panel 406. Application of a force by instrument 134 against panel 408 creates an original marking 136 on panel 408 and simultaneously creates a substantially identical copy 136 of marking 138 on panel 406. It is appreciated that the paper stock from which the blank 400 is formed has an elongated rectangular strip, or other geometric shape, e.g. a circle, oval, triangle, or other polygonal shape, of mating microencapsulated coatings on either panel 406 and 408 such that a record copy can be created for the user as well as an original copy of a marking. The paper stock is then stamped to create an appropriate blank, and the blank is then assembled to form an envelope.

Figure 10:
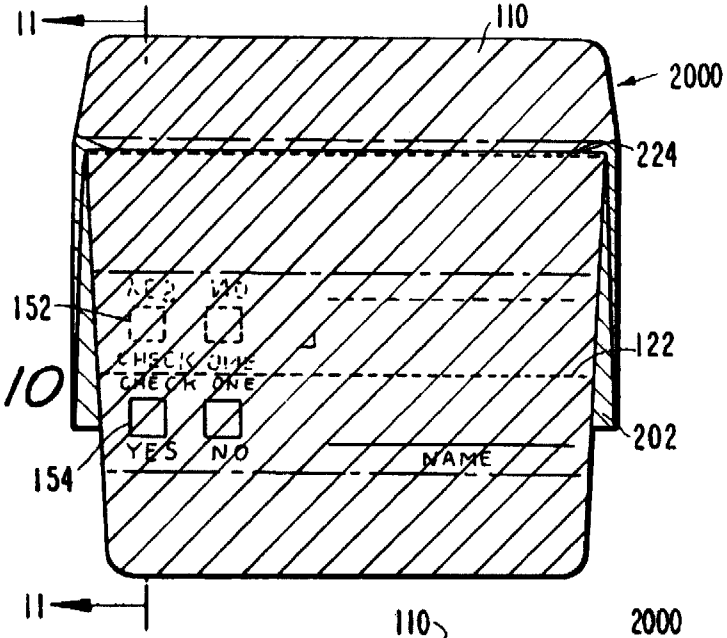
FIG. 10 is a top plan view of the blank of FIG. 9 partially assembled.
Figure 12:
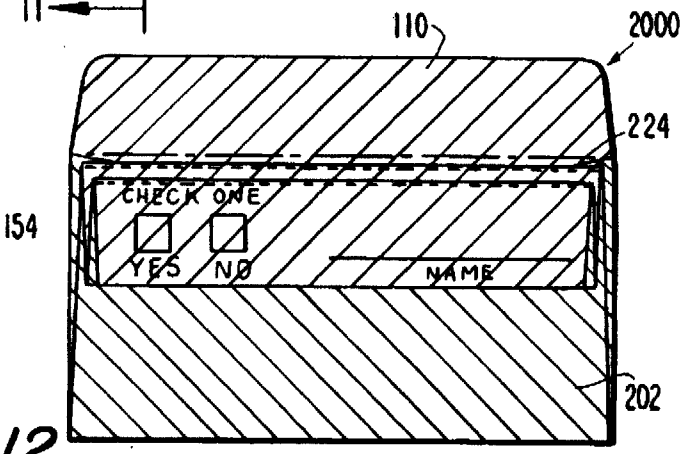
FIG. 12 is top plan view of a fully assembled envelope of FIG. 10.
Figure 11:
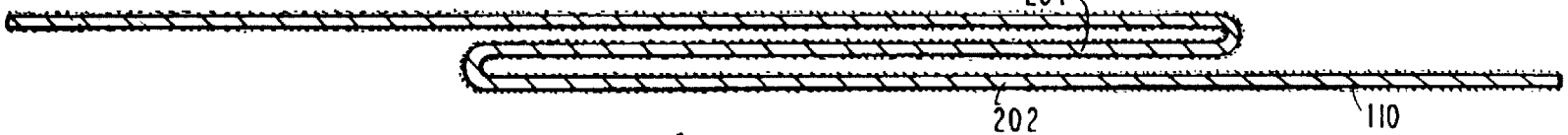
FIG. 11 is a side cross-sectional view of the envelope of FIG. 10 along sectional line -11.

Beads 146 when broken by instrument 134 create the markings desired. As illustrated in FIG. 14, the panels and sub-panel assembly are folded four times. In FIG. 9, the side coming out of the drawing is front coated; whereas the underside thereof is back coated. The front coated papers are CF White #20, and the back coated papers are CB White #16 Black Print made and sold by Appleton Papers Inc. which utilizes the conventional NCR paper brand of carbonless paper. As illustrated in FIG. 10, the envelope 2000 of these Figures is the reverse side of the blank shown in FIG. 9, and this reverse side has the coated back side coming out of the drawing.

Figure 21:
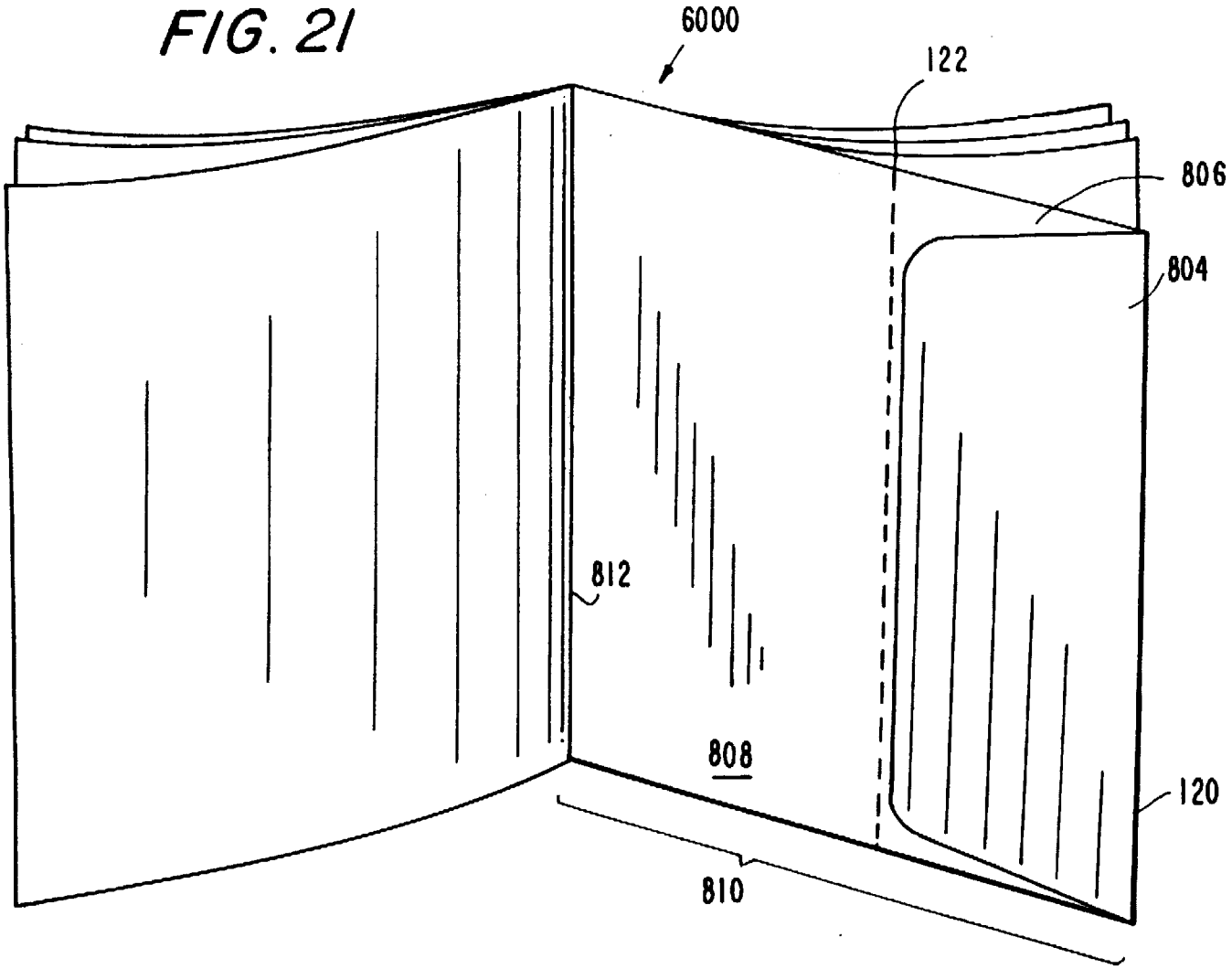
FIG. 21 is a perspective view of an magazine insert according to the present invention.

As illustrated in FIG. 21 the envelopes and envelope blanks as described herein can also be used as magazine inserts. Magazine 6000 contains insert 810. Insert 810 comprises panels 804, 806, 808, and is constructed of seven point post card stock in one variant, and of the carbonless paper stock described above in another variant. Panel 808 contains optionally advertising or promotional indicia thereon. Panel 806 is fabricated from a front coated carbonless paper and panel 804 is formed from a back coated carbonless paper. Panel 804 forms an original copy and panel 806 forms a record copy analogous to panels 106, 206, and 306. Panel 808 is separated from panel 806 along side edge 122. It is further appreciated that the envelopes 1000, 2000, 3000 and 4000 described herein can also be connected to panel 808. In yet a further variant a multiple folded assembly as described herein is also connected to panel 808, or a side edge of one of the panels is connected to panel 808 or magazine binding 812.

Figure 22A:
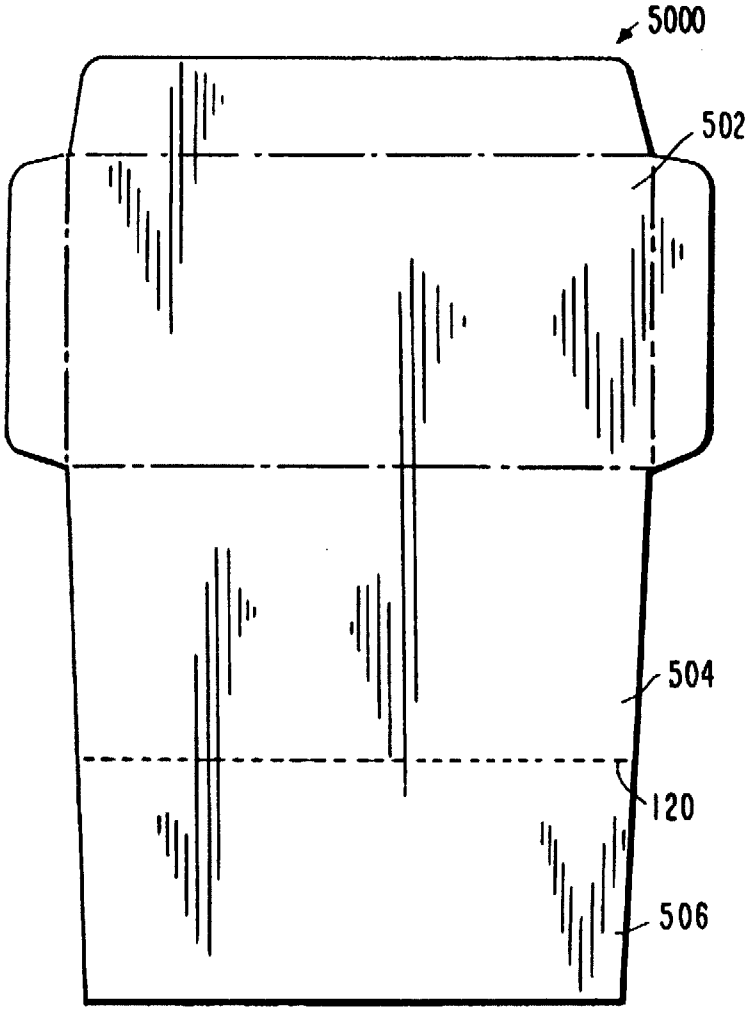
FIG. 22*a* is a top plan view of a three panel envelope blank.

As illustrated in FIG. 22*a*, the envelope blank 5000 can also be constructed of a three panel construction. In this embodiment, panels 504 and 506 are analogous to panels 406, 408, respectively. Here, an instrument 134 is used to create a marking on the side of panel 408 that projects up and out of the drawing, while the record marking is created on the side of panel 504 that projects down and into the drawing. With this embodiment panel 506 is separated from panel 504 along side edge 120, and inserted into the cavity formed from envelope panels 502, 504 when they are assembled. In this variant order information appears on the outside back panel of the envelope formed from blank 5000 and it is open to review by third parties. It is appreciated that receipts for banking transactions and record copies thereof are provided with the envelopes described herein.

While only a few, preferred embodiments of the invention have been described hereinabove, those of ordinary skill in the art will recognize that the embodiment may be modified and altered without departing from the central spirit and scope of the invention. Thus, the preferred embodiment described hereinabove is to be considered in all respects as illustrative and not restrictive, the scope of the invention being indicated by the appended claims, rather than by the foregoing description, and all changes which come within the meaning and range of equivalency of the claims are intended to be embraced herein.

I claim:

1. An envelope blank, comprising: multiple panel portions connected together as a unit along fold lines, at least one of said multiple panel portions being capable of being written thereon with a writing instrument to create an original marking, and having a least one other panel portion which when folded against said at least one of said multiple panel portions is disposed in a juxtaposed position so as to make a simultaneous duplication of said original marking thereon; and in which said at least one other panel portion being formed of a front coated carbonless paper; and a back coated patch portion of carbonless paper secured to said at least one of said multiple panel portions such that it is interposed between the panel portions when they are in the juxtaposed position; whereby the panel portion with the duplicated marking serving as a receipt upon removal of same from said envelope blank.

2. The envelope blank according to claim 1 wherein said multiple panel portions comprise four panels, including first and second panels having a side edge therebetween and having said original writing and the duplicated marking thereon, and said first panel having at least a pair of end flaps; said second and a third panel having a further side edge therebetween; and said third and a fourth panel having yet an additional side edge therebetween, and said side edges between adjacent panels of said multiple panel portions of said envelope blank being formed by a fold line or a perforated line, thereby forming an in-line chain of panels.

3. The envelope blank according to claim 2, in which all of said end flaps have fold lines disposed between said end flaps and said first panel; said first panel and said second panel have a fold line at said side edge therebetween; said second and third panels having a severable perforation at said side edge therebetween; and said third and fourth panels having a severable perforation at said side edge therebetween, whereby said second and third panels being detachable from one another, and said third and fourth panels being detachable from each other along said severable perforations.

4. The envelope blank according to claim 2, further comprising indicia disposed on said fourth panel.

5. The envelope blank according to claim 2, in which said first panel further comprises a window.

6. The envelope blank according to claim 2, in which all of said panels are fabricated from said front coated carbonless paper, and said front coated carbonless paper including microencapsulated beads for creating said duplicated marking on said third panel.

7. The envelope blank according to claim 2 wherein said fourth panel has said patch panel attached thereto.

8. The envelope blank according to claim 7, in which said patch panel has a encapsulated coating thereon for creating said duplicated marking by means of said writing instrument applied against the coating.

9. The envelope blank of claim 1, wherein said multiple panel portions comprise at least three panel portions.

10. The envelope blank of claim 9, further including a fourth panel portion.

11. The envelope blank of claim 10, wherein said multiple panel portions form an L-shape envelope blank.

12. The envelope blank of claim 10, wherein said multiple panel portions form an S-shape envelope blank.

13. The envelope blank of claim 10, further including an address window in one of said multiple panel portions.

14. The envelope blank of claim 9, wherein said multiple panel portions are all in line.

15. The envelope blank of claim 14, wherein said multiple panel portions is a "mail order" magazine insert.

16. A blank for making an envelope from paper sheet stock, comprising: a first panel having a sealing flap; a second panel connected to said first panel; a third panel connected to said second panel; and a fourth panel, having front and reverse sides, connected to said third panel, at least said third and fourth panels comprising a front coated carbonless paper; and, said fourth panel comprising a composite panel with a patch portion being of a back coated carbonless paper attached to said front coated side of said fourth panel by means of an adhesive;

whereby the assembly of a said blank into said envelope and use of an instrument permits a user to create a visible record marking on at least said third panel by applying a force with said instrument against said reverse side of said fourth panel, said force further creating an original marking on one of said panels, and said record marking being a substantially identical record copy of said original marking and being created simultaneously with the creation of said original marking.

17. The blank for making an envelope from paper sheet stock according to claim 16, in which said patch portion includes a back coated side facing said third panel.

18. The blank for making an envelope from paper sheet stock according to claim 16, in which said patch portion is no larger than said fourth panel.

19. An envelope made from microencapsulated coated paper comprising: a first panel having a sealing flap, a pair of end flaps and a first side edge; a second panel connect to said first panel along said first side edge which is disposed between said first and second panels, said second panel having another side edge; said second panel being connected to said pair of end flaps and to said first panel along said first side edge to form an envelope cavity therebetween; a third panel connected to said second panel along said another side edge, said third panel having a further side edge, said further side edge being disposed opposite to said another side edge of said second panel; and, a fourth panel, which includes a patch portion, connected to said third panel along said further side edge of said third panel; said first, said second and said third panels, said sealing flap, said pair of end flaps being fabricated from a front coated carbonless paper, said fourth panel comprising a back coated carbonless paper; and said third and fourth panels being folded in a manner such that at least a portion of said fourth panel rests against at least a portion of said third panel.

whereby the use of an instrument creates a visible record marking on said third panel by applying a force with said instrument against a reverse side of said fourth panel to form an original marking thereon, and a reproduction of said record marking being a substantially identical record copy of said original marking and being created substantially simultaneously with the creation of said original marking.

20. The envelope according to claim 19, in which said patch portion comprises a microencapsulated coating that when activated creates a visible marking.

21. The envelope according to claim 19, in which said patch portion is adhesively secured to said fourth panel.

22. The envelope according to claim 19, in which said patch portion is applied to said fourth panel with said back coated side facing said third panel.

23. The envelope according to claim 19, in which said patch portion is no larger than said fourth panel.

24. The envelope according to claim 19, in which all of said flaps have fold lines disposed between said flaps and said first panel; said first panel and said second panel having a fold line at said side edge therebetween; said second and third panels having a severable perforation at said side edge therebetween; and said third and fourth panels having a severable perforation at said side edge therebetween, whereby said second and third panels are readily detachable one from another along said severable perforation, and upon separation said third panel and any panel temporarily attached thereto are readily insertable into said envelope cavity.

25. An envelope made from microencapsulated coated paper comprising a first panel having a sealing flap and a pair of end flaps; a second panel connect to said first panel, said second panel being connected to said pair of end flaps to form an envelope cavity; a third panel connected to said second panel; and a fourth panel connected to said third panel, all of said panels being folded accordion style, and said third and fourth panels comprise a pair of smaller panels, and forming a folded assembly portion; all said panels and end flaps being fabricated from a coated carbonless paper; wherein application of a force against said folded assembly portion activates said carbonless paper creating a reproduction of markings upon one of said panels of said folded assembly portion.

26. The envelope according to claim 25 in which said reproductive marking is created on said third panel.

27. The envelope according to claim 25, in which each of said smaller panels are of substantially equal size.

28. The envelope according to claim 25, further comprising a fold line between each pair of smaller panels.

* * * * *